US009315305B2

(12) United States Patent
Robinson

(10) Patent No.: US 9,315,305 B2
(45) Date of Patent: Apr. 19, 2016

(54) CANNED BEVERAGE SEALER

(71) Applicant: Delores Walton Robinson, Chicago, IL (US)

(72) Inventor: Delores Walton Robinson, Chicago, IL (US)

( * ) Notice: Subject to any disclaimer, the term of this patent is extended or adjusted under 35 U.S.C. 154(b) by 27 days.

(21) Appl. No.: 13/915,357

(22) Filed: Jun. 11, 2013

(65) Prior Publication Data

US 2014/0361029 A1 Dec. 11, 2014

(51) Int. Cl.

*B65D 45/00* (2006.01)
*B65D 51/16* (2006.01)
*B65D 51/00* (2006.01)

(52) U.S. Cl.

CPC ..... *B65D 51/007* (2013.01); *B65D 2517/0041* (2013.01)

(58) Field of Classification Search

CPC ..... B65D 17/166; B65D 2517/0014; B65D 45/02; B65D 2517/0034; F16B 13/063
USPC ..... 220/243, 246, 710, 720, 361; 411/346, 411/29, 342
See application file for complete search history.

(56) References Cited

U.S. PATENT DOCUMENTS

| | | | | | |
|---|---|---|---|---|---|
| 838,524 | A | * | 12/1906 | Collettte | 220/243 |
| 3,019,950 | A | * | 2/1962 | Callegari | 222/542 |
| 4,429,804 | A | * | 2/1984 | Pease | 220/247 |
| 4,756,440 | A | | 7/1988 | Gartner | |
| 4,793,755 | A | * | 12/1988 | Brown | 411/342 |
| 5,147,166 | A | * | 9/1992 | Harker | 411/29 |
| 6,969,220 | B2 | * | 11/2005 | Anquetin | 411/38 |
| 7,159,732 | B2 | | 1/2007 | Smith | |
| 2009/0277862 | A1 | | 11/2009 | Masuda | |

* cited by examiner

*Primary Examiner* — Shawn M Braden

(57) ABSTRACT

A device for sealing an opened canned beverage. The device may include a circular main body with a rim. The device may further include a sealing mechanism. The sealing mechanism may include a threaded stem having a knob on the top and running through an opening in the main body. The sealing mechanism may further include a live hinge bar that may include a top portion and a bottom portion. The top portion and the bottom portion may be hinged together. The top portion may be connected to the inside surface of the main body and the bottom portion may be connected to a threaded ring that surrounds the threaded stem.

8 Claims, 3 Drawing Sheets

CANNED BEVERAGE SEALER

BACKGROUND OF THE INVENTION

The present invention relates to a canned beverage sealer and, more particularly, to a canned beverage sealer that may preserve the contents of an opened can.

Currently, after opening a canned beverage, the user must finish the drink or dispose of the unfinished beverage. If the user tries to keep the unfinished beverage for later, the beverage remains open to the elements. Further, since a lot of canned beverages are carbonated, the carbonation may escape from the beverage and the drink may become flat. The freshness of the drink may be compromised.

As can be seen, there is a need for a device that may seal an opened canned beverage for later consumption.

SUMMARY OF THE INVENTION

In one aspect of the present invention, a beverage can device comprises: a main body having an outside surface, an inside surface, and a rim, wherein the main body forms an opening through the outside surface and the inside surface; a threaded stem running through the opening, wherein the stem has a top end and a bottom end, wherein the top end comprises a knob and wherein the knob is adjacent to the outside surface of the main body; at least one live hinge bar having a top portion and a bottom portion, wherein the top portion and the bottom portion meet at a first hinge, and wherein the top portion is connected to the inside surface of the body by a second hinge; and a threaded connector attached to the bottom portion of the at least one live hinge by a third hinge, and surrounding the threaded stem.

In another aspect of the present invention, a method of resealing a beverage comprises: providing a beverage can device comprising: a main body having an outside surface, an inside surface, and a rim, wherein the main body forms an opening through the outside surface and the inside surface; a threaded stem running through the opening, wherein the stem has a top end and a bottom end, wherein the top end comprises a knob and wherein the knob is adjacent to the outside surface of the main body; at least one live hinge bar having a top portion and a bottom portion, wherein the top portion and the bottom portion meet at a first hinge, and wherein the top portion is connected to the inside surface of the body by a second hinge; and a threaded connector attached to the bottom portion of the at least one live hinge by a third hinge, and surrounding the threaded stem; placing the threaded stem and the at least one live hinge bar into an open beverage can, wherein the rim of the main body rests on a top of the can; rotating the knob and thereby rotating the threaded stem, wherein the threaded connector runs upward towards the top end of the threaded stem, wherein the live hinge bar bends at the hinges and the top portion of the live hinge bar applies pressure to an under surface of the top of the can and the rim applies pressure to an outer surface of the top of the can.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a device for sealing an opened canned beverage. The device may include a circular main body with a rim. The device may further include a sealing mechanism. The sealing mechanism may include a threaded stem having a knob on the top and running through an opening in the main body. The sealing mechanism may further include a live hinge bar that may include a top portion and a bottom portion. The top portion and the bottom portion may be hinged together. The top portion may be connected to the inside surface of the main body and the bottom portion may be connected to a threaded ring that surrounds the threaded stem.

The present invention may include a can cork to seal in freshness and prevent spilling for a canned beverage. The present invention may include an airtight seal to prevent spilling of the beverage and to sustain flavor and freshness. The present invention may sustain the freshness of an unfinished beverage, and therefore instead of throwing away the unfinished beverage, a user may keep the beverage for later. This may save money for the user.

Figure 1:
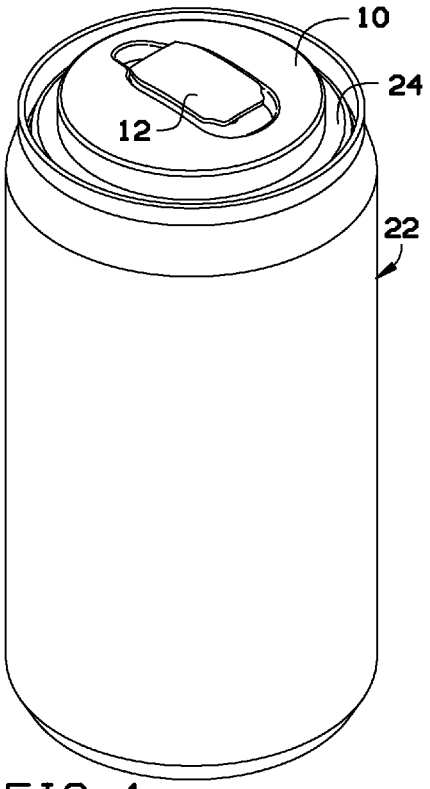
FIG. 1 is a perspective view of the present invention shown in use.
Figure 2:
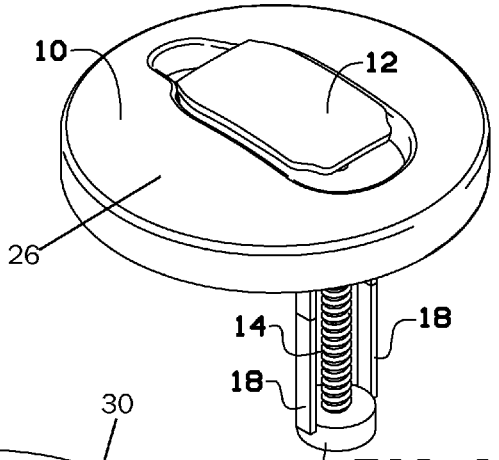
FIG. 2 is a top perspective view of the present invention.
Figure 3:
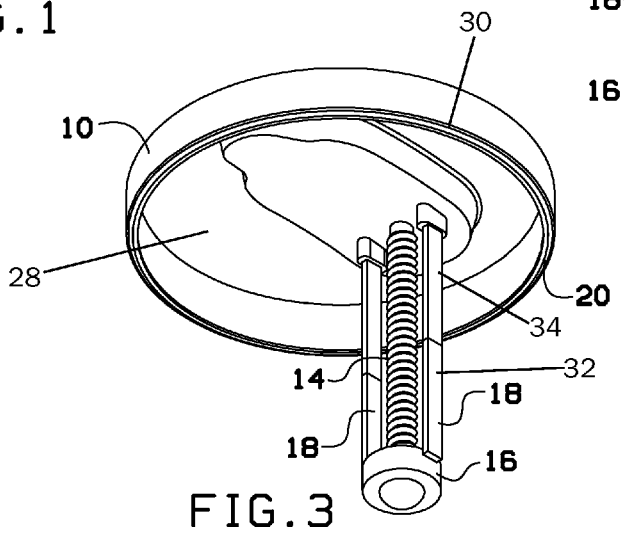
FIG. 3 is a bottom perspective view of the present invention.
Figure 4:
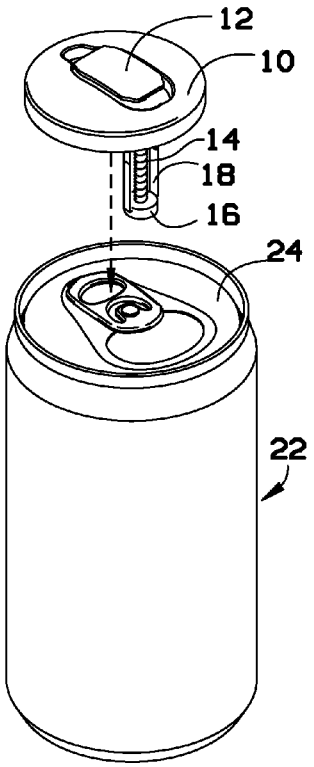
FIG. 4 is an exploded view of the present invention.
Figure 5:
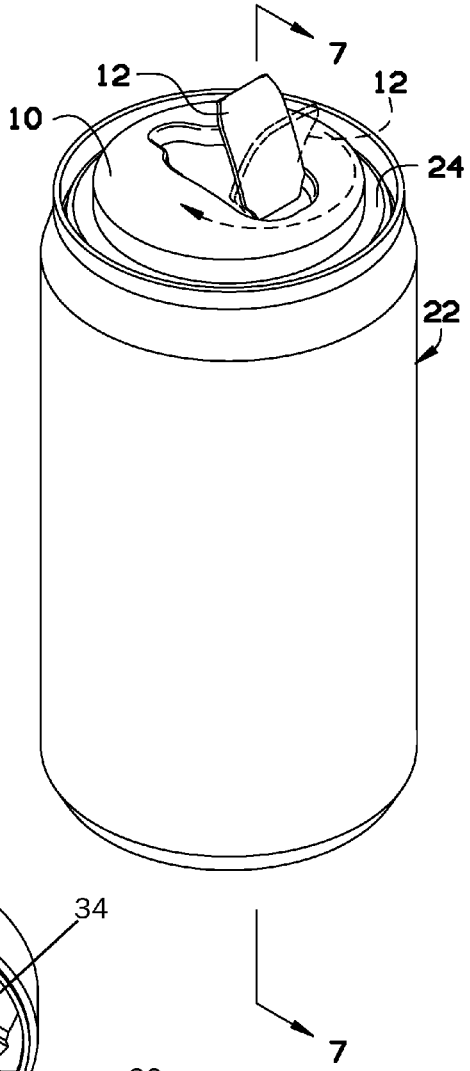
FIG. 5 is a top perspective view of the present invention shown in use and demonstrating usage of an exemplary knob of FIG. 1.
Figure 6:
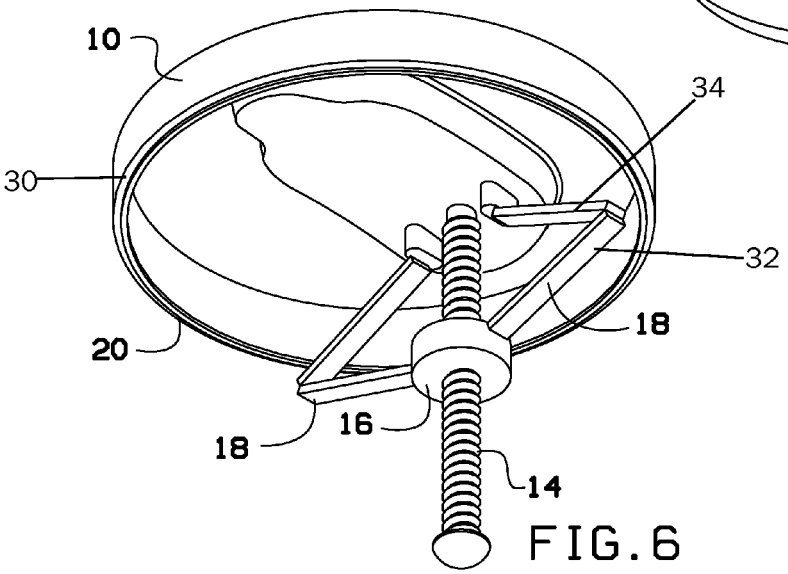
FIG. 6 is a bottom perspective view of the present invention demonstrated in a closed configuration.
Figure 7:
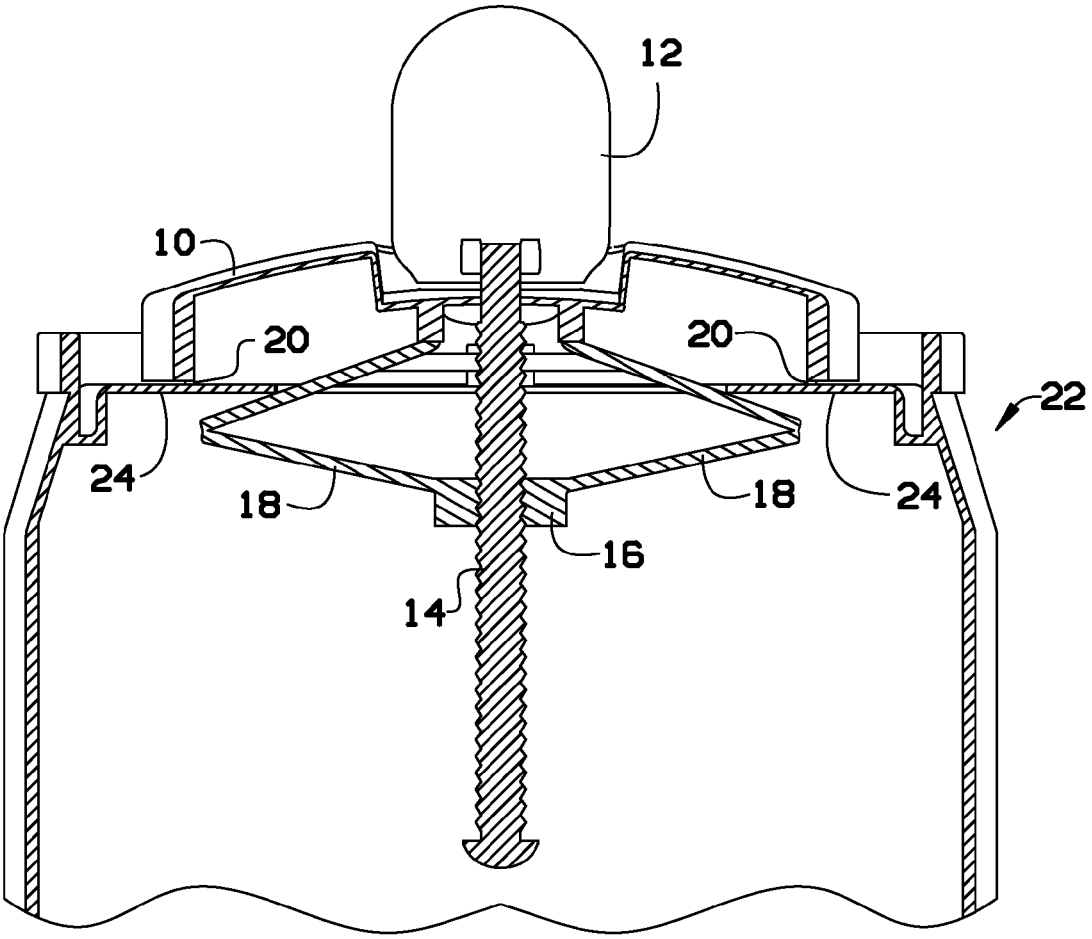
FIG. 7 is a section detail view of the present invention along line 7-7 in FIG. 1.

Referring to FIGS. 1 through 7, the present invention may include a main body 10. The main body 10 may cover the opening of the canned beverage 22. In certain embodiments, the main body 10 may be circular to conform to the top of the canned beverage 22. The main body 10 may include an outside surface 26, an inside surface 28 and a rim 30 that may join the outside surface 26 and the inside surface 28. The rim 30 may encompass the parameter or circumference of the main body 10. In certain embodiments, the rim 30 may include a rubber seal 20 so that when the present invention is applied to the can 22, the rubber seal 20 may provide for an airtight seal.

The present invention may further include a sealing mechanism. The sealing mechanism may be an integral part of the main body 10. In certain embodiments, the sealing mechanism may be near the center of the body 10. The sealing mechanism may include a knob 12 attached to a threaded stem 14. The knob 12 may be positioned on the outside surface 26 of the body 10. In certain embodiments, the outside surface 26 may include an indentation in which the knob 12 rests. The threaded stem 14 may extend through the outside surface 26 and the inside surface 28 of the body 10. The threaded stem 14 may extend through an opening in the body 10 that has dimensions smaller than the knob 12. In certain embodiments, the knob 12 may be hinged to the stem 14.

The present invention may further include at least one live hinge bar 18. The live hinge bar 18 may include a top portion 34 and a bottom portion 32. The top portion 34 and the bottom portion 32 may join at a first hinge and may thereby bend relative to one another. The top portion 34 may be attached to the inside surface 28 of the main body 10 by a second hinge.

The bottom portion 32 may connect to a threaded connector such as a threaded ring 16 by a third hinge. The threaded ring 16 may be threaded with the threaded stem 14. The second hinge and the third hinge may bend in the opposite direction as the first hinge.

In certain embodiments, the at least one live hinge bar 18 may include a first live hinge bar 18 and a second live hinge bar 18. The first live hinge bar 18 and the second live hinge bar 18 may be oriented on opposite sides of one another. Therefore, the bottom portion 32 of the first live hinge 18 may be connected to the threaded ring 16 on an opposite side as the bottom portion 32 of the second live hinge 18.

The present invention may include a closed position and an open position. The open position may include the live hinge bar 18 substantially straight and the threaded ring 16 oriented near a bottom of the threaded stem 14. The closed position may include the first hinge of the at least one live hinge bar 18 substantially bent and the threaded ring oriented closer to the main body 10. Therefore, a user may seal an opened can 22 by placing the threaded steam 14 and the live hinge bar 18 into the opened can 22 in the open position. The user may then rotate the knob 12 and thereby rotate the threaded stem 14. The threaded ring 16 runs upward towards the top end of the threaded stem 14, and the live hinge bar 18 bends at the hinges. The top portion of the live hinge bar 18 applies pressure to an under surface of the top of the can 24 and the rim 30 applies pressure to an outer surface of the top of the can 24. The rubber seal 20 may thereby seal the beverage to preserve freshness of the drink.

It should be understood, of course, that the foregoing relates to exemplary embodiments of the invention and that modifications may be made without departing from the spirit and scope of the invention as set forth in the following claims.

What is claimed is:

1. A beverage can device comprising:

a main body having an outside surface, an inside surface, and a rim formed about a perimeter of the main body and extending perpendicular relative to the inside surface, wherein the rim is configured to form an airtight seal when pressed against a beverage can, wherein the main body forms an opening through the outside surface and the inside surface;

a threaded stem running through the opening, wherein the stem has a top end and a bottom end, wherein the top end comprises a knob and wherein the knob is adjacent to the outside surface of the main body;

at least one live hinge bar having a top portion and a bottom portion, wherein the top portion and the bottom portion meet at a first hinge, and wherein the top portion is connected to the inside surface of the body by a second hinge; and a threaded connector attached to the bottom portion of the at least one live hinge by a third hinge, and surrounding the threaded stem.

2. The beverage can device of claim 1, wherein the at least one live hinge bar comprises a first live hinge bar and a second live hinge bar, wherein the bottom portion of the first live hinge is connected to the threaded connector on an opposite side as the bottom portion of the second live hinge.

3. The beverage can device of claim 1, wherein the main body is a circular shape.

4. The beverage can device of claim 1, wherein the rim comprises a rubber seal.

5. The beverage can device of claim 1, wherein the knob is hinged to the threaded stem.

6. The beverage can device of claim 1, wherein the threaded connector is a threaded ring.

7. The beverage can device of claim 6, comprising a closed position and an open position, wherein the open position comprises the at least one live hinge bar substantially straight and the threaded ring oriented near a bottom of the threaded stem, wherein the closed position comprises the live hinge bar substantially bent at the first hinge, the second hinge and the third hinge and the threaded ring oriented closer to the main body.

8. The beverage can device of claim 1, wherein the main body comprises an indentation, wherein the knob rests within the indentation.

* * * * *